United States Patent [19]

Kessler et al.

[11] Patent Number: 4,460,095

[45] Date of Patent: Jul. 17, 1984

[54] MOLDED RACK

[75] Inventors: Ronald N. Kessler, Youngstown, Ohio; June S. Rose, 1040 Colonial Dr., Youngstown, Ohio 44505; Myron E. Ullman, Jr., Canfield, Ohio

[73] Assignees: Willow Molded Plastics, Inc.; June S. Rose, both of Youngstown, Ohio

[21] Appl. No.: 331,563

[22] Filed: Dec. 17, 1981

[51] Int. Cl.[3] ..... A47F 7/00

[52] U.S. Cl. ..... 211/69.1; 211/50; D19/78; D6/302; D6/471; D6/467

[58] Field of Search ..... 211/50, 69.1; 248/174; 40/152, 901, 156, 341, 122, 120; D19/91, 78, 86, 20, 21, 22, 23, 24; D6/130, 180, 140, 188, 85

[56] References Cited

U.S. PATENT DOCUMENTS

| | | | |
|---|---|---|---|
| D. 76,601 | 4/1927 | Boe . | |
| D. 146,978 | 6/1947 | Mack, Jr. . | |
| D. 162,153 | 2/1951 | Gilfert | D19/78 |
| D. 180,429 | 6/1957 | Taylor . | |
| D. 232,335 | 8/1974 | Glover . | |
| D. 233,289 | 10/1974 | Barone . | |
| D. 234,557 | 3/1975 | Tiburzi . | |
| D. 236,112 | 7/1975 | Staats . | |
| 236,457 | 1/1881 | Reimer . | |
| D. 241,895 | 10/1976 | Forbes . | |
| D. 249,353 | 9/1978 | Juergens . | |
| D. 251,466 | 4/1979 | Ciminelli . | |
| D. 255,753 | 7/1980 | Hoffman et al. | D6/188 X |
| D. 261,902 | 11/1981 | Oakley . | |
| D. 262,978 | 2/1982 | Nagley . | |
| D. 267,383 | 12/1982 | Liptak et al. | D6/188 X |
| D. 267,808 | 2/1983 | Russo . | |
| D. 268,847 | 5/1983 | Hollister et al. | D19/20 |
| 799,167 | 9/1905 | Jorgensen . | |
| 1,831,712 | 11/1931 | Keenan | 211/695 |
| 2,242,296 | 5/1941 | Fraser | 211/69.9 X |
| 2,325,324 | 7/1943 | Kent . | |
| 2,404,563 | 2/1945 | Berliner . | |
| 2,427,612 | 4/1945 | Lobb . | |
| 2,500,838 | 3/1950 | Le Vine | 211/69.9 |
| 2,505,615 | 4/1946 | Glass . | |
| 2,959,296 | 11/1960 | Case . | |
| 3,084,457 | 6/1959 | Schott . | |
| 4,199,883 | 4/1980 | Cross | D19/91 X |

*Primary Examiner*—J. Franklin Foss
*Assistant Examiner*—Robert W. Gibson, Jr.
*Attorney, Agent, or Firm*—David A. Burge

[57] ABSTRACT

A free-standing rack molded from plastics material provides compartments for upright storage of a booklet, a memo pad or slate-type writing device, and an elongate writing instrument. The rack is configured such that it can be formed in toto in a two-part mold of relatively simple configuration having no side-core pulls.

12 Claims, 19 Drawing Figures

MOLDED RACK

CROSS-REFERENCE TO RELATED APPLICATION

MAGAZINE, MEMO PAD AND PENCIL RACK, Ser. No. 331,564, filed Dec. 17, 1981 herewith.

BACKGROUND OF THE INVENTION

1. Field of the Invention

The present invention relates to a free-standing rack molded from plastics materials for holding, in an upright orientation, a booklet or magazine, a memo pad or slate-type writing device, and an elongate writing instrument.

2. Prior Art

While memo-pad and pencil holders of a variety of configurations are known, most such holders are not of a free-standing type, and most include no provision for supporting a memo pad or slate-type writing device and a pencil in a readily accessible, upright orientation, nor do they provide a compartment for supporting a booklet or magazine.

With the increasing popularity of television viewing as a pastime, a number of periodicals are being published which catalog television program offerings on a day-by-day basis. As a result of the lack of a specific place to store such a publication at a location in close association with one's television set, viewers often temporarily misplace their program-listing publications.

With the increasing use of television as an advertising medium wherewith viewers are asked to write down addresses or telephone numbers of advertisers, a problem with the effectiveness of television advertising has been the not uncommon failure of viewers to have pencil and paper located in close proximity to their television sets at times when information to be transcribed is presented.

SUMMARY OF THE INVENTION

The present invention addresses and overcomes the foregoing and other drawbacks of the prior art by providing a novel and improved, free-standing rack which can be molded inexpensively from plastics material and which includes separate compartments for supporting in upright, readily accessible attitudes, a booklet or magazine, a memo pad or slate-type writing device, and an elongate writing instrument. The rack of the present invention is particularly useful as a support for a program-listing magazine, a memo pad or slate-type writing device, and a pencil at a location in close proximity to one's television set.

A feature of racks embodying the preferred practice of the present invention is the ease with which they can be molded without the necessity of utilizing a complex mold with expensive side-core-pull components. A further feature of the invention lies in the design of a free-standing rack which, despite complexities of configuration, can be molded easily and inexpensively.

These and other features and a fuller understanding of the invention may be had by referring to the following description and claims taken in conjunction with the accompanying drawings.

DESCRIPTION OF THE PREFERRED EMBODIMENTS

Figure 1:
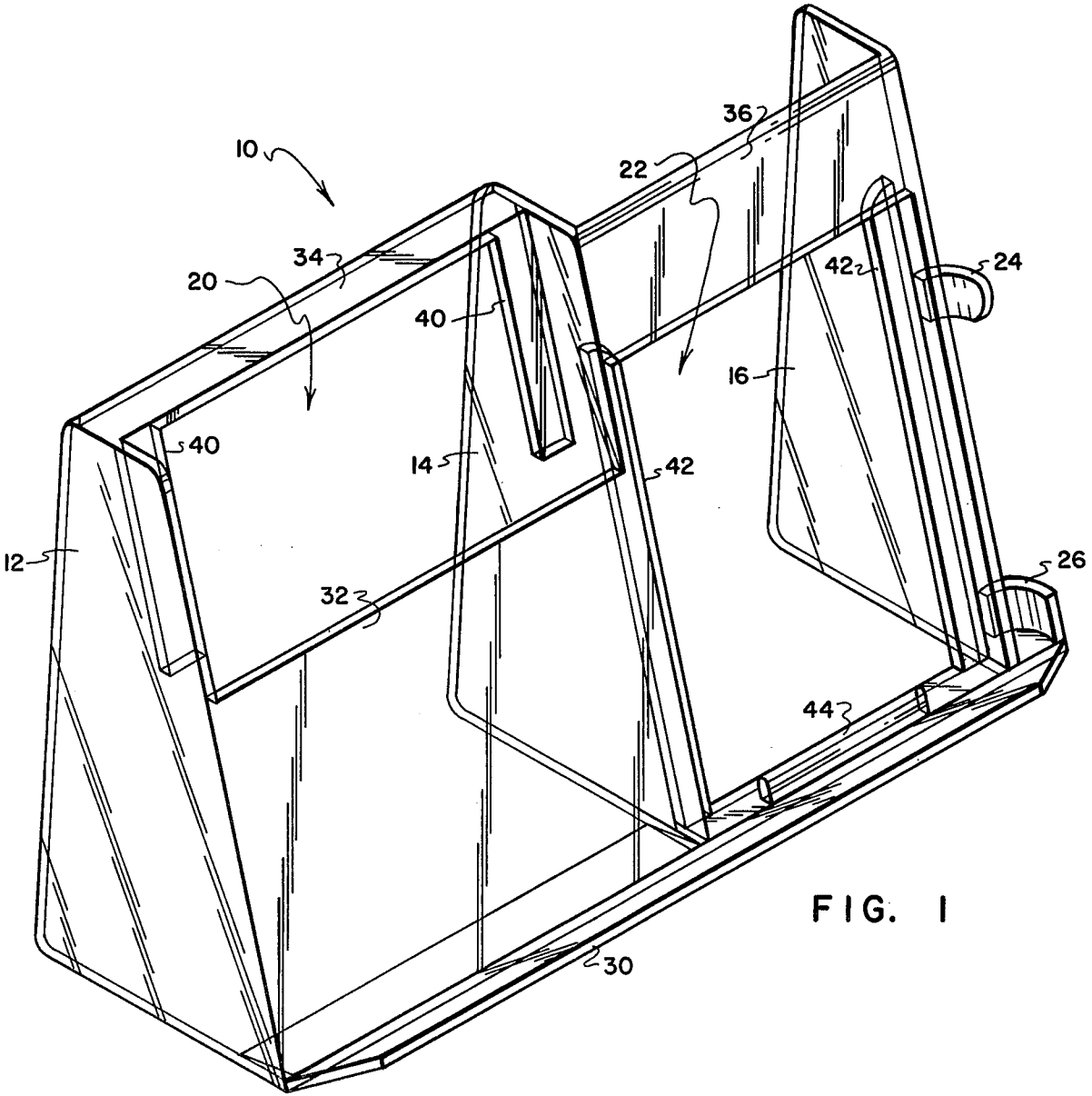
FIG. 1 is a perspective view of one embodiment of the present invention.
Figure 2:
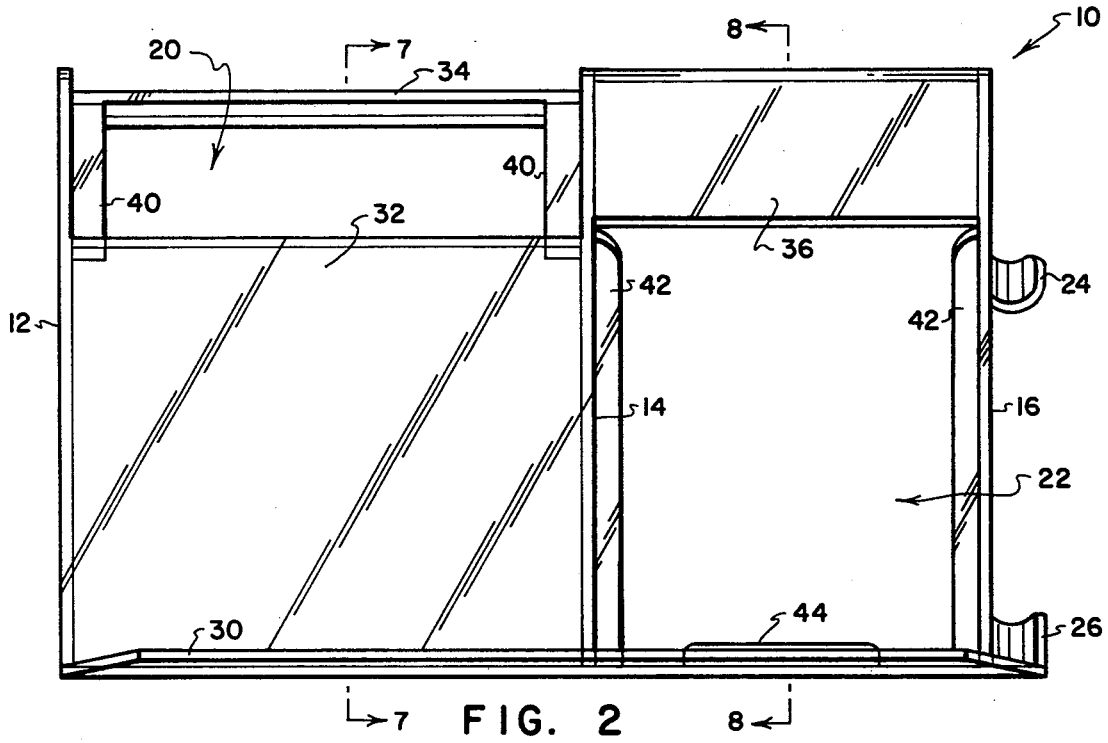
FIG. 2 is a front side elevational view thereof.
Figure 3:
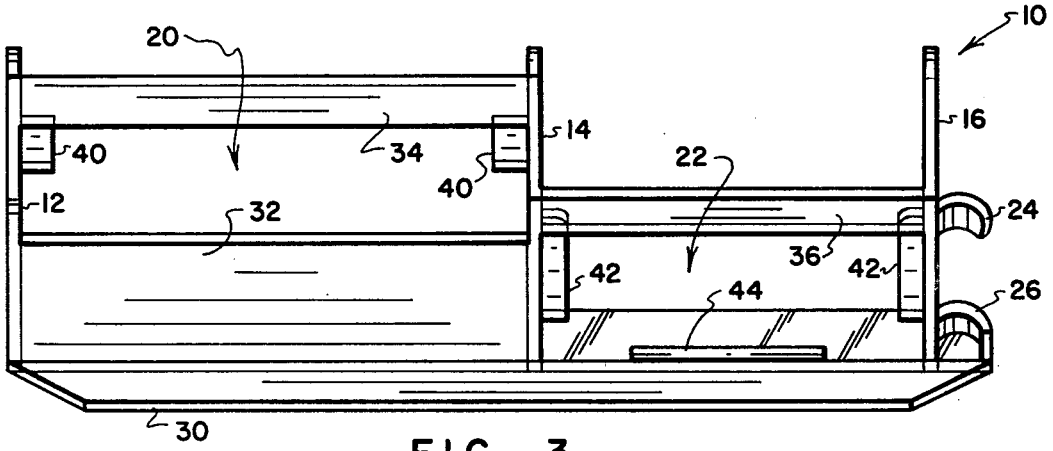
FIGS. 3 and 4 are top and bottom plan views thereof.
Figure 4:
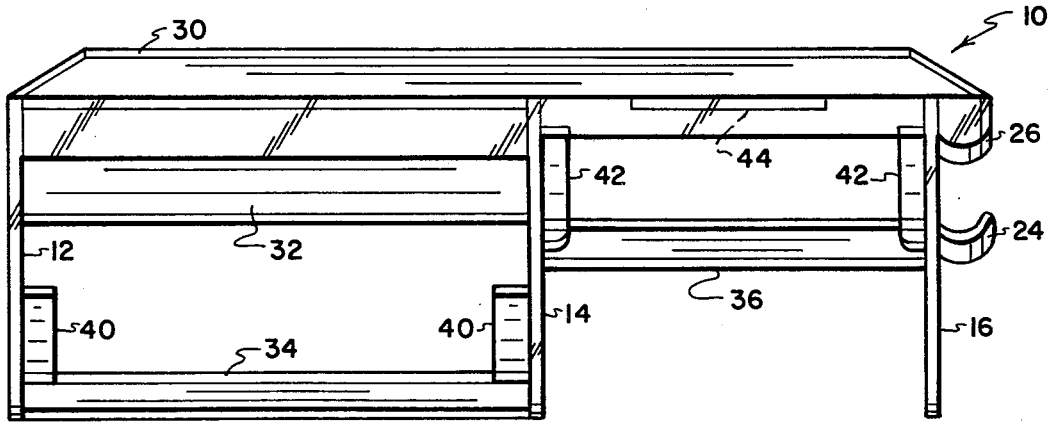
Figure 5:
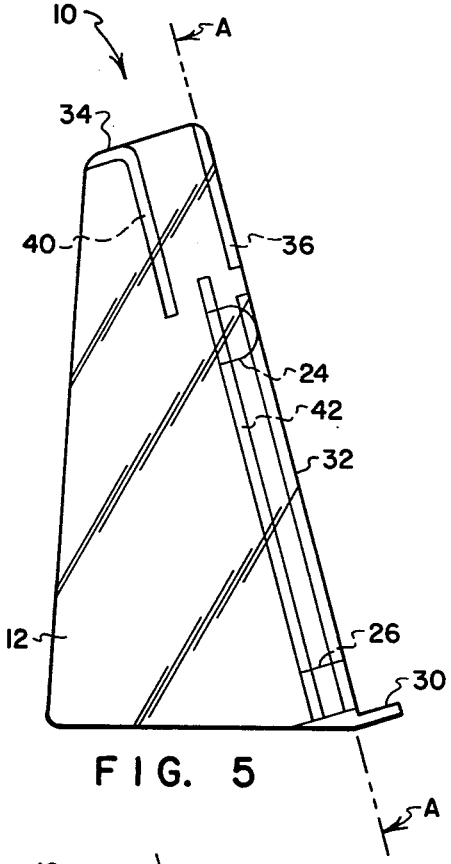
FIGS. 5 and 6 are left and right end elevational views thereof.
Figure 6:
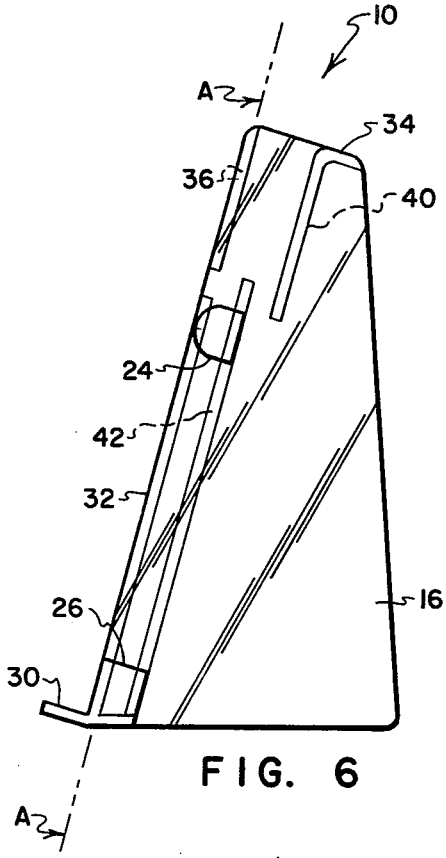
Figure 7:
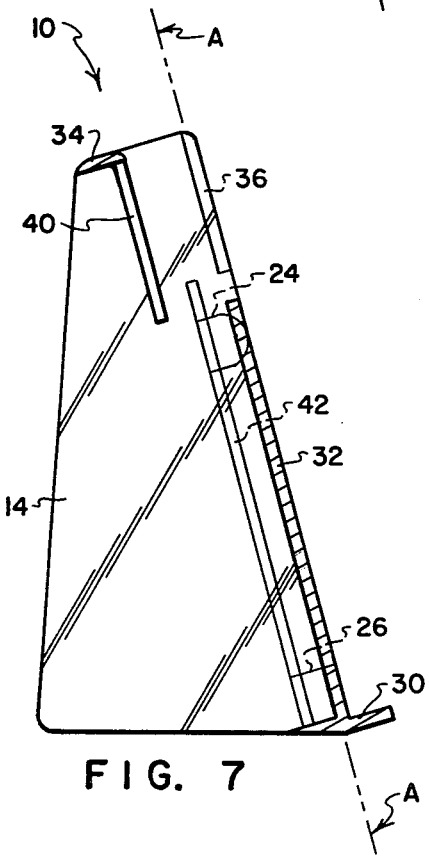
FIGS. 7 and 8 are sectional views as seen from planes indicated by lines 7—7 and 8—8 in FIG. 2.
Figure 8:
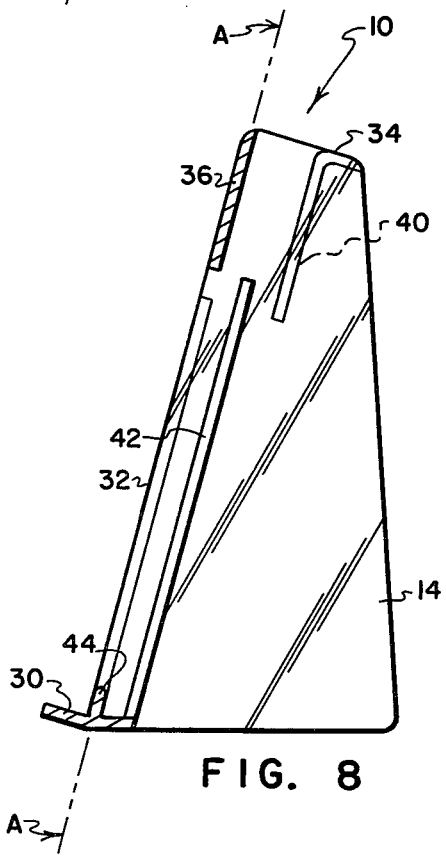
Figure 9:
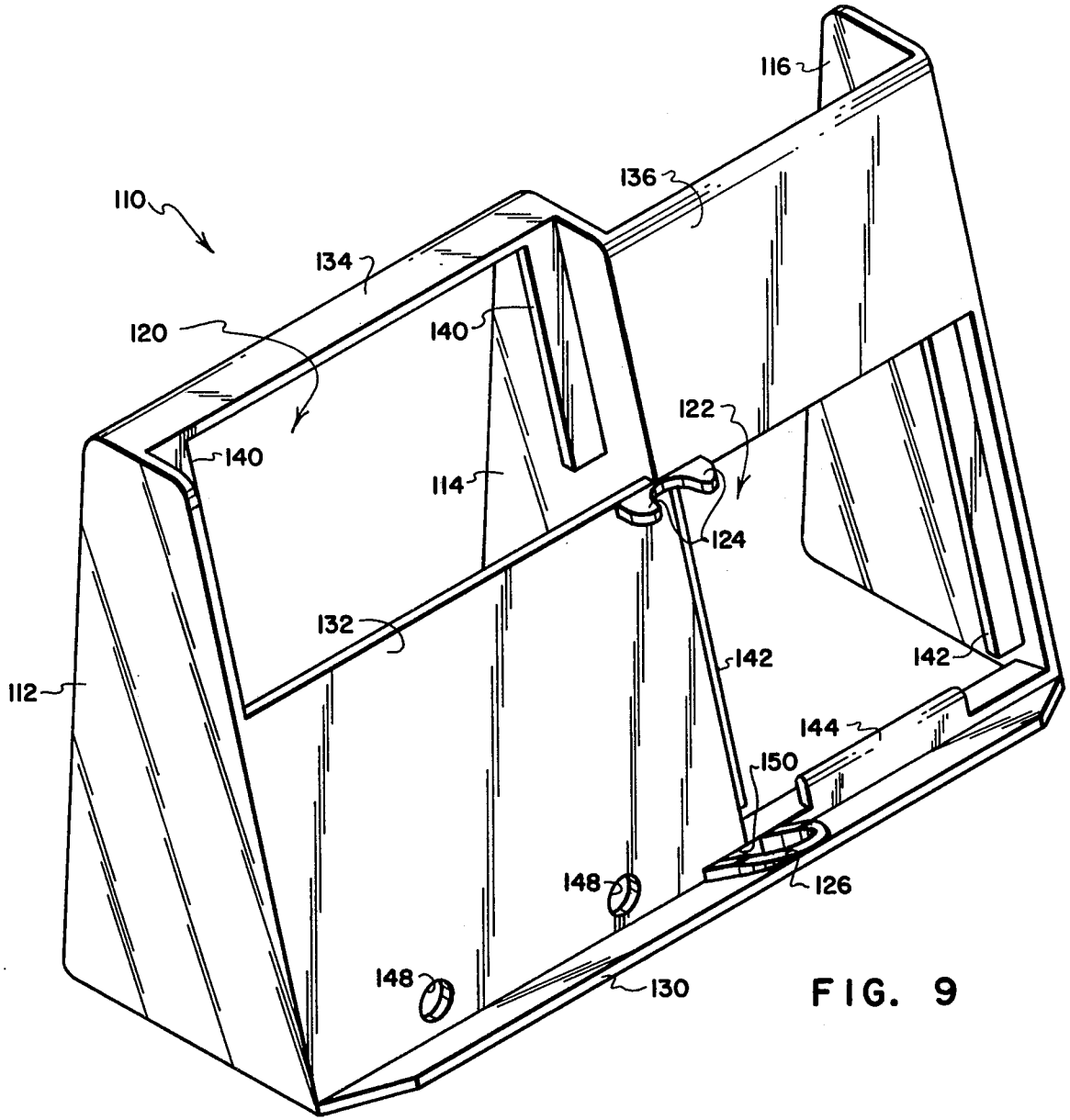
FIG. 9 is a perspective view of a preferred embodiment of the present invention.

Referring to FIGS. 1–6, one embodiment of a molded rack incorporating features of the present invention is indicated generally by the numeral 10.

The rack 10 is formed as an integral, one-piece structure, preferably using injection molding techniques. While any of a variety of moldable materials may be used to form the rack 10, plastics material such as high impact or crystal polystyrene, or an acrylic plastic is preferred due to the strength and rigidity of these materials, and due to the good appearance they provide in molded products. The rack 10 illustrated in the drawings is shown as being formed from a transparent plastics material.

The rack 10 has left, central and right upstanding support walls, indicated by the numerals 12, 14,16. An upwardly-opening compartment 20 is provided between the support walls 12, 14 for receiving a booklet or magazine (not shown). A forwardly-opening compartment 22 is provided between the support walls 14, 16 for receiving a memo pad (not shown). Upper and lower curved formations 24, 26 project from the right support wall 16 for supporting an elongate writing instrument (not shown).

All three of the support walls 12, 14, 16 are interconnected by an upwardly-inclined base wall 30 which extends the full width of the rack 10 and underlies the lower curved formation 26. The left and central support walls 12, 14 are interconnected by a front wall 32 and a top wall 34. The central and right support walls 14, 16 are interconnected by a front wall 36.

Opposed projections 40 are formed on the support walls 12, 14 and extend into opposite sides of the upwardly-opening compartment 20 to cooperate with the top wall 34 to provide back support for a booklet or magazine positioned in the compartment 20. Opposed projections 42 are formed on the support walls 14, 16 and extend into opposite sides of the forwardly-opening compartment 22 to provide back support for a memo pad or slate-type writing device positioned in the compartment 22. An upwardly-extending rib 44 is provided atop the base wall 30 for engaging the lower front edge of a memo pad or slate-type writing device to assist in positioning it in the compartment 22.

The front walls 32, 36 lie in a common plane which is indicated generally by a line A—A in FIGS. 5–8. All of the components of the rack 10 are configured and oriented with respect to the plane A—A in such a way as enables the rack 10 to be injection-molded in a two-part mold (not shown) without any necessity for providing the mold with expensive side-core pulls.

In order to mold the rack 10 in a two-part mold, cavities are formed in the mold halves in such a way that the plane A—A of a rack 10 being formed in the mold is oriented to extend perpendicular to the path along which the mold halves move relative to each other when the mold is opened and closed. Additionally, the above-described components of the rack 10 are oriented and configured such that they can be formed by mold halves which open, i.e., move apart following a molding operation, by moving relative to each other along a travel path which is perpendicular to the plane A—A.

The orientation of the above-described components which is utilized to enable the rack 10 to be injection molded by a two-part mold involves several features. The support walls 12, 14, 16, the base wall 30, and the top wall 34 are oriented to extend in planes which are perpendicular to the plane A—A, whereby the mold-half portions which form forward and rearward portions of these walls can be separated by moving alongside the walls after the walls have been molded. The projections 40, 42 and the rib 44 extend in planes paralleling the plane A—A, whereby their front surfaces are formed by portions of one mold half, their rear surfaces are formed by portions of the other mold half, and the mold halves may be separated by movement in a direction perpendicular to the plane A—A. The curved formations 24, 26 are likewise configured such that their forward and rearward surfaces can be formed by portions of separate mold halves, with the mold halves being separable after molding by moving relative to each other in directions which are perpendicular to the plane A—A.

Configuring the above-described components of the rack 10 in such a manner as will enable the rack 10 to be injection molded by a two-part mold also involves several features. If the rack 10 is viewed from a direction which is perpendicular to the plane A—A, it will be seen that none of the above-described components overlie each other (i.e., none of the components have surfaces which are located directly in front of or directly behind surfaces of another component). By way of example, when the rack 10 is viewed from a direction perpendicular to the plane A—A, it will be seen that the projections 40 do not depend below the top edge of the front wall 32, whereby (1) the mold half which forms the front face of the front wall 32 can also form the front faces of the projections 40, and (2) the mold half which forms the rear face of the front wall 32 can also form the rear faces of the projections 40. Similarly, the projections 42 have upper ends which do not extend upwardly behind the bottom edge of the front wall 36, whereby (1) the mold half which forms the front face of the front wall 36 can also form the front faces of the projections 42, and (2) the mold half which forms the rear face of the front wall 36 can also form the rear faces of the projections 42.

Referring to FIGS. 9–14, a molded rack embodying the preferred practice of the present invention is indicated generally by the numeral 110.

The rack 110 is formed as an integral, one-piece structure, preferably using injection molding techniques. While any of a variety of moldable materials may be used to form the rack 110, plastics material such as high impact or crystal polystyrene, or an acrylic plastic is preferred due to the strength and rigidity of these materials, and due to the good appearance they provide in molded products. The rack 110 illustrated in the drawings is shown as being formed from an opaque plastics material.

Figure 17:
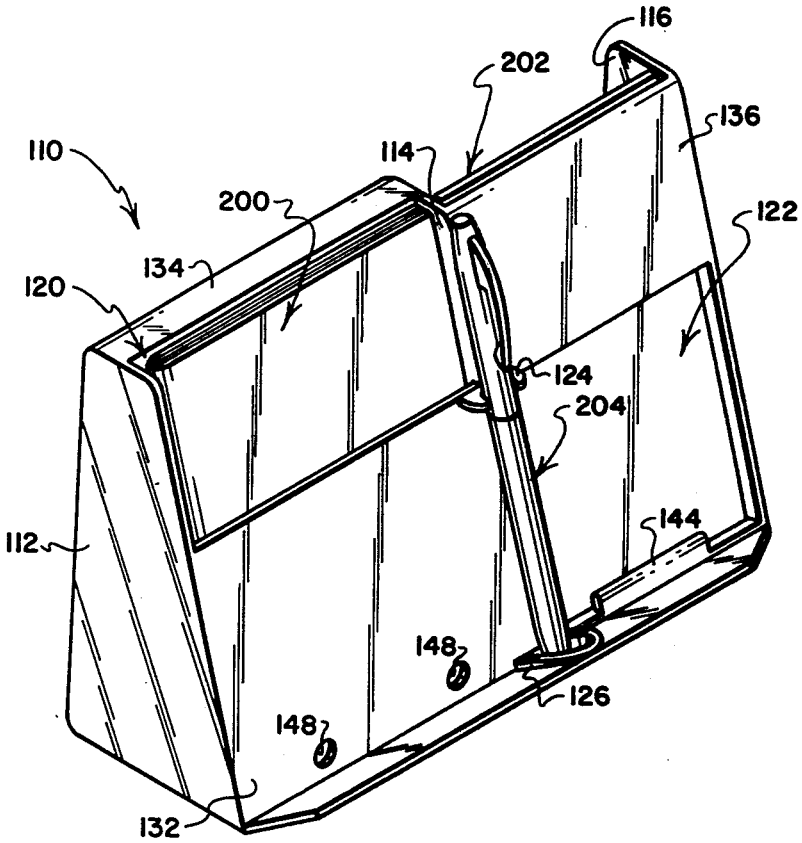
FIG. 17 is a perspective view, similar to FIG. 9, but showing a booklet, a slate-type writing device, and an elongate writing instrument supported on the rack; and, FIGS. 18 and 19 are sectional views as seen from planes indicated by lines 18—18 and 19—19 in FIG. 10.

Referring to FIG. 17, the rack 110 has left, central and right upstanding support walls, indicated by the numerals 112, 114, 116. An upwardly-opening compartment 120 is provided between the support walls 112, 114 for receiving a booklet or magazine, indicated by the numeral 200. A forwardly-opening compartment 122 is provided between the support walls 114, 116 for receiving a slate-type writing device, indicated generally by the numeral 202. Upper and lower curved formations 124, 126 project forwardly from the region near the central support wall 114 for supporting an elongate writing instrument, indicated generally by the numeral 204.

Referring again to FIGS. 9–14, all three of the support walls 112, 114, 116 are interconnected by an upwardly-inclined base wall 130 which extends the full width of the rack 110 and underlies the lower curved formation 126. The left and central support walls 112, 114 are interconnected by a front wall 132 and a top wall 134. The central and right support walls 114, 116 are interconnected by a front wall 136.

Opposed projections 140 are formed on the support walls 112, 114 and extend into opposite sides of the upwardly-opening compartment 120 to cooperate with the top wall 134 to provide back support for a booklet or magazine positioned in the compartment 120. Opposed projections 142 are formed on the support walls 114, 116 and extend into opposite sides of the forwardly-opening compartment 122 to provide back support for a memo pad or slate-type writing device positioned in the compartment 122.

Figure 10:
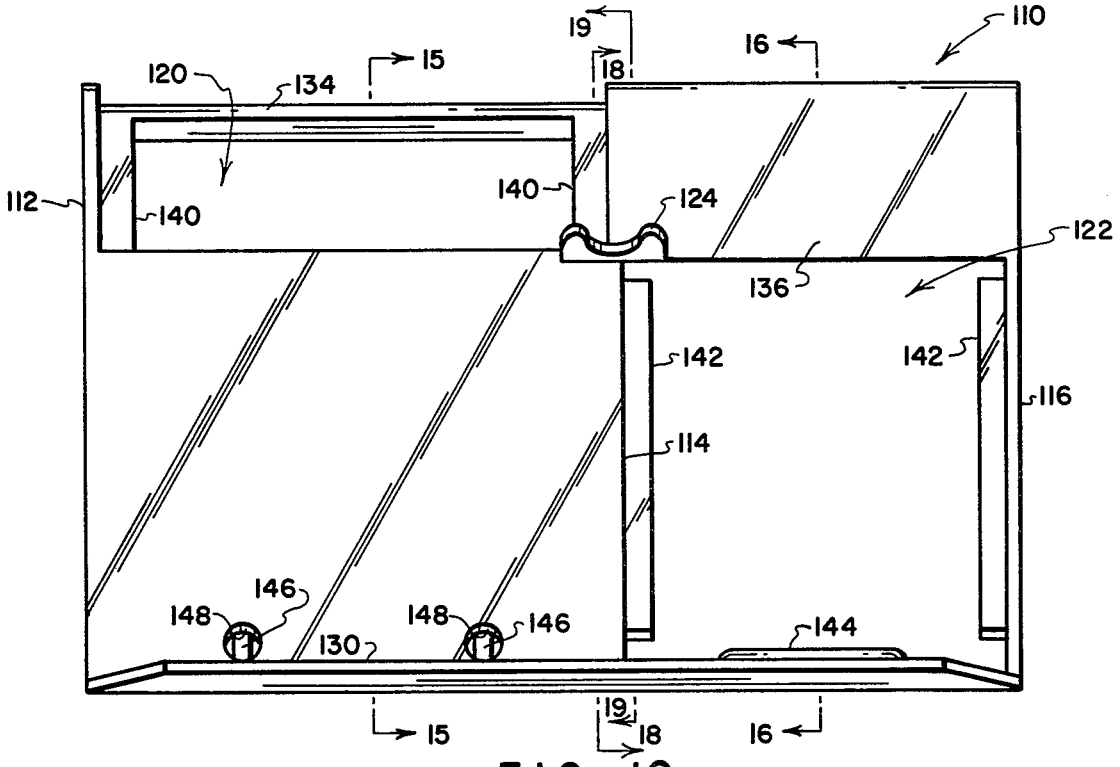
FIG. 10 is a front side elevational view thereof.
Figure 11:
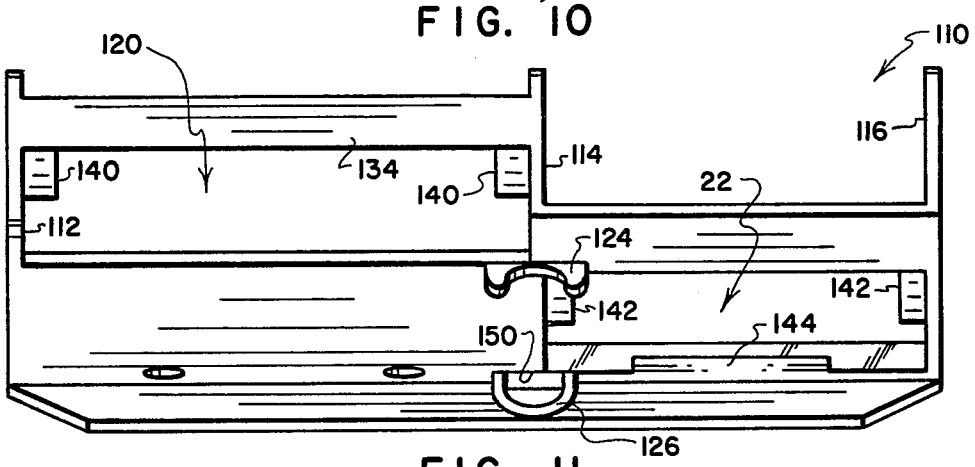
FIGS. 11 and 12 are top and bottom plan views thereof.
Figure 12:
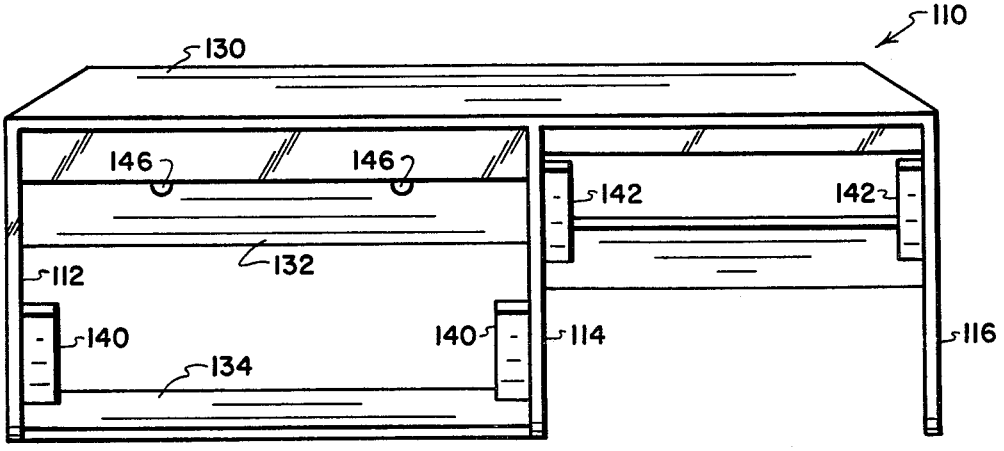
Figure 13:
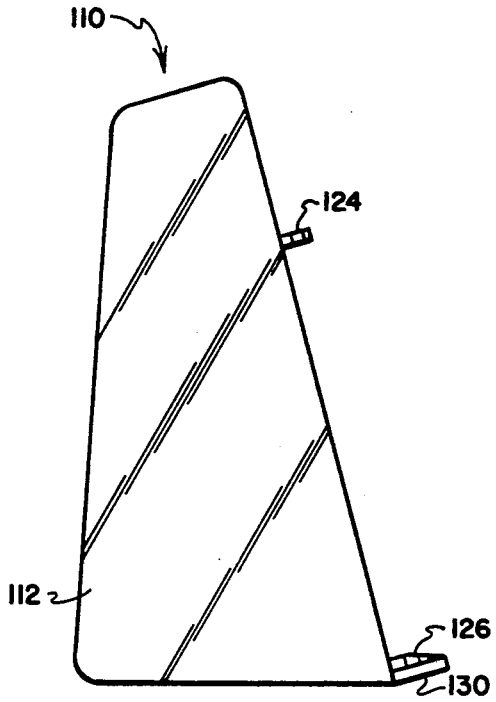
FIGS. 13 and 14 are left and right end elevational views thereof.
Figure 14:
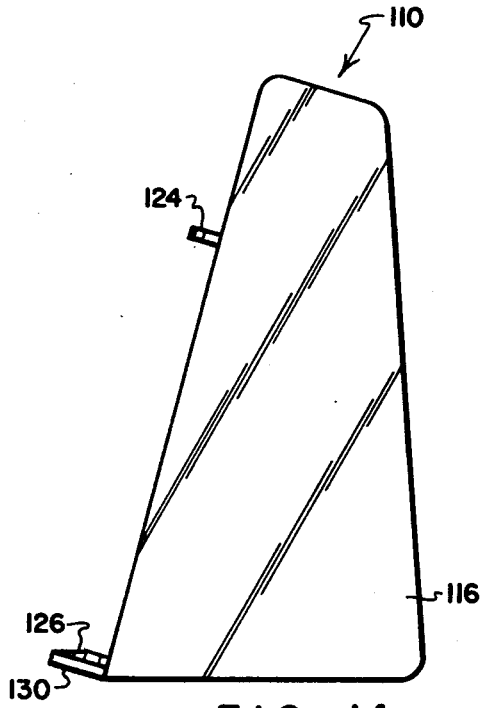
Figure 15:
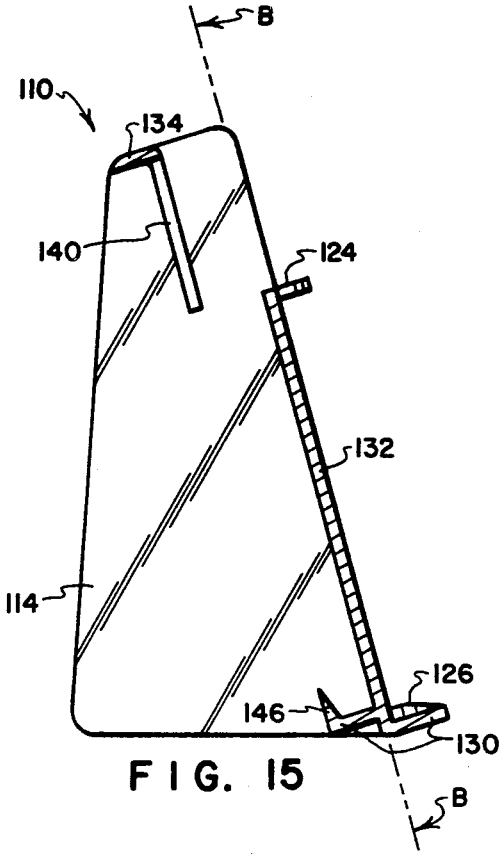
FIGS. 15 and 16 are sectional views as seen from planes indicated by lines 15—15 and 16—16 in FIG. 10.
Figure 16:
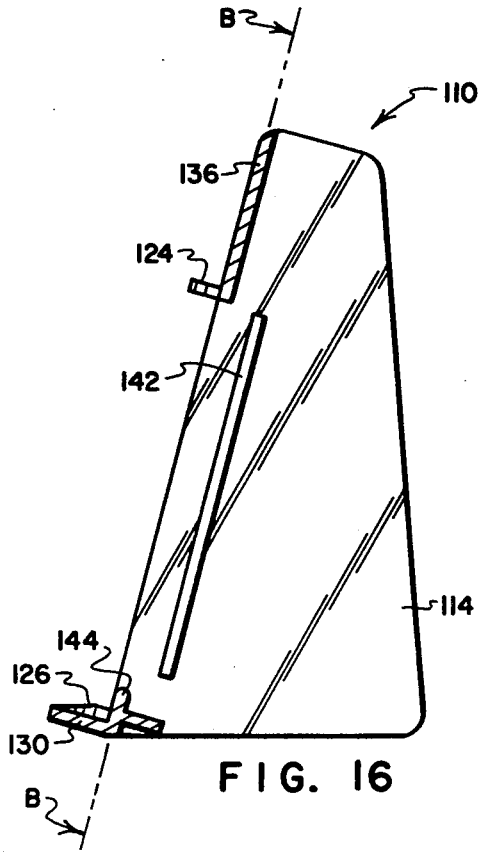
Figure 18:
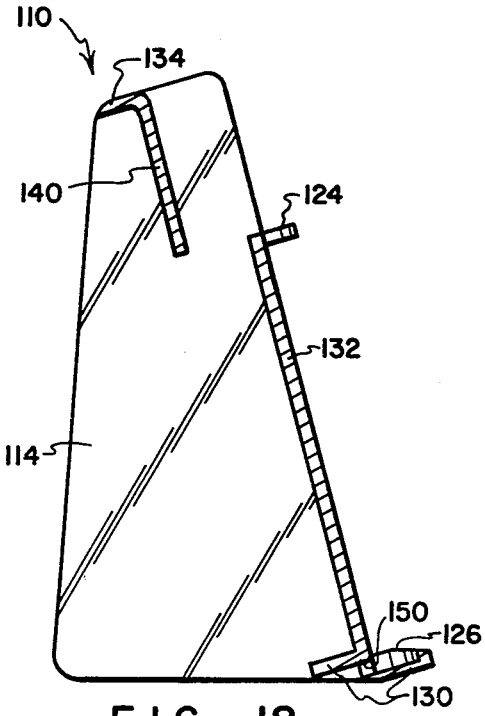
Figure 19:
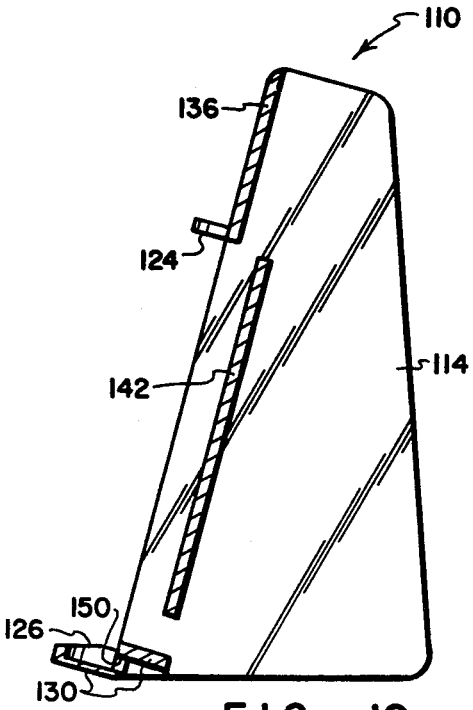

Referring to FIG. 16 in conjunction with FIGS. 9–14, an upwardly-extending rib 144 is provided atop the base wall 130 for engaging the lower front edge of a memo pad or slate-type writing device to assist in positioning it in the compartment 122. Referring to FIG. 15 in conjunction with FIGS. 9–14, a pair of pointed, upwardly-extending tabs 146 are provided atop the base wall 130 for engaging the lower rear edge of a booklet or magazine to assist in positioning it in the compartment 122. As is best seen in FIG. 10, a pair of holes 148 are formed through the front wall 132 at locations forwardly of the pointed tabs 146. Referring to FIGS. 18 and 19, a slot-like opening 150 is formed through the front wall 132 and through the base of the rib 144 at a location immediately behind the lower curved formation 126.

Referring to FIGS. 15 and 16, the front walls 132, 136 lie in a common plane which is indicated by a line B—B. All of the components of the rack 110 are configured and oriented with respect to the plane B—B in such a way as enables the rack 110 to be injection-molded in a two-part mold (not shown) without any necessity for providing the mold with expensive side core pulls.

In order to mold the rack 110 in a two-part mold, cavities are formed in mold halves in such a way that the plane B—B of a rack 110 being formed in the mold is oriented to extend perpendicular to the path along which the mold halves move relative to each other when the mold is opened and closed. Additionally, the above-described components of the rack 110 are oriented and configured such that they can be formed by mold halves which open, i.e., move apart following a molding operation, by moving relative to each other along a travel path which is perpendicular to the plane B—B.

The orientation of the above-described components which is utilized to enable the rack 110 to be injection molded by a two-part mold involves several features. The support walls 112, 114, 116, the base wall 130, and the top wall 134 are oriented to extend in planes which are perpendicular to the plane B—B, whereby the mold-half portions which form forward and rearward portions of these walls can be separated by moving alongside the walls after the walls have been molded. The projections 140, 142 and the rib 144 extend in planes paralleling the plane B—B, whereby their front surfaces are formed by portions of one mold half, their rear surfaces are formed by portions of the other mold half, and the mold halves may be separated by movement in a direction perpendicular to the plane B—B. The pointed tabs 146 and the curved formations 124, 126 are likewise configured such that their forward and rearward surfaces can be formed by portions of separate mold halves. In the case of the tabs 146, their forward surfaces are formed by mold portions which project through the holes 148. In the case of the lower curved formation 126, its rearward surface is formed by a mold part which projects through the slot-like opening 150.

Configuring the above-described components of the rack 110 in such a manner as will enable the rack 110 to be injection molded by a two-part mold also involves the following features. If the rack 110 is viewed from a direction which is perpendicular to the plane B—B, it will be seen that none of the above-described components overlie each other (i.e., none of the components have surfaces which are located directly in front of or directly behind the surfaces of another component. By way of example, when the rack 110 is viewed from a direction perpendicular to the plane B—B, it will be seen that the pointed tabs 146 do not extend to a height above the holes 148, and the lower curved formation 126 does not extend to a height above that of the slot-like opening 150, whereby the tabs 146 can have their forward surfaces formed by mold parts which extend through the holes 148, and the formation 126 can have its rearward surface formed by a mold part which extends through the opening 150.

Although the invention has been described in its preferred form with a certain degree of particularity, it is understood that the present disclosure of the preferred form has been made only by way of example and numerous changes in the details of construction and combination and arrangement of parts may be resorted to without departing from the spirit and scope of the invention as hereinafter claimed. It is intended that the patent shall cover, by suitable expression in the appended claims, whatever features of patentable novelty exist in the invention disclosed.

What is claimed is:

1. A free-standing one-piece rack formed from molded plastics material, comprising:

(a) left, center and right upstanding support walls having lower portions extending in a common plane for supporting the rack in a free-standing manner atop a flat surface, each of said support walls being substantially flat, and all of the support walls extending in spaced, parallel planes;

(b) a first front wall interconnecting the left and center support walls, and a second front wall interconnecting the right and center support walls, said first and second front walls extending in a common plane which extends perpendicular to the spaced, parallel planes of the support walls;

(c) a base wall interconnecting the left, center and right support walls;

(d) formation means carried by a selected one of the right and left support walls and cooperating with a portion of the base wall to define an upstanding holder for receiving and supporting an elongate writing instrument;

(e) the left and center support walls defining opposite sides of a first compartment;

(f) the right and center support walls defining opposite sides of a second compartment;

(g) one of the first and second compartments being configured to receive a booklet, and having first support means extending into said one compartment to provide back support for a booklet positioned therein;

(h) the other of the first and second compartments being configured to receive writing surface means providing a writing surface and having second support means extending into said other compartment to provide back support for a writing surface means positioned therein;

(i) at least parts of the first and second front walls, the formation means, the first support means and the second support means being configured and oriented with respect to the common plane of the first and second front walls such that their frontward-facing surface portions may be formed by one of a pair of mold halves which are arranged to move relative to each other during opening and closing along a path of travel which extends perpendicular to the common plane of the first and second front walls, and such that their rearward-facing surface portions may be formed in toto by the other of said pair of mold halves; and, (j) a top wall interconnecting the center support wall with at least one of the right and left support walls, the top wall being substantially flat and extending in a plane which is perpendicular to the common plane of the first and second front walls, and which is perpendicular to the parallel planes of the support walls.

2. The rack of claim 1 wherein each of the first and second support means includes a pair of projections which extend into the associated compartment from locations along such support walls as define opposite sides of the associated compartment.

3. The rack of claim 1 wherein the formation means include a pair of curved, hook-shaped projections which cooperate with the associated support wall to define a forwardly-facing holder for receiving and supporting an elongate writing instrument.

4. The rack of claim 1 wherein the formation means include a pair of structures extending forwardly with respect to the center upstanding support wall to define a forwardly-facing holder for receiving and supporting an elongate writing instrument at a location between the first and second compartments.

5. The rack of claim 1 additionally including upstanding projection means carried on the base wall and extending into said other of the first and second compartments for overlying a front edge portion of a writing surface means positioned therein to assist in retaining the writing surface in said other compartment.

6. The rack of claim 1 additionally including upstanding projection means carried on the base wall and extending into said one compartment for underlying a rear edge portion of a booklet positioned therein.

7. A free-standing one-piece rack formed from molded plastics material, comprising:

(a) left, center and right upstanding support walls having lower portions extending in a common plane for supporting the rack in a free-standing manner atop a flat surface, each of said support walls being substantially flat, and all of the support walls extending in spaced, parallel planes;

(b) a first front wall interconnecting the left and center support walls, and a second front wall interconnecting the right and center support walls, said first and second front walls extending in a common plane which extends perpendicular to the spaced, parallel planes of the support walls;

(c) a base wall interconnecting the left, center and right support walls;

(d) formation means carried by a selected one of the right and left support walls and cooperating with a portion of the base wall to define an upstanding holder for receiving and supporting an elongate writing instrument;

(e) the left and center support walls defining opposite sides of an upwardly opening first compartment;

(f) the right and center support walls defining opposite sides of an upwardly opening second compartment;

(g) one of the upwardly opening first and second compartments being configured to receive a booklet, and having first support means extending into said one compartment to provide back support for a booklet positioned therein;

(h) the other of the upwardly opening first and second compartments being configured to receive writing surface means providing a writing surface and having second support means extending into said other compartment to provide back support for a writing surface means positioned therein;

(i) at least one opening being formed through at least a selected one of the first and second front walls for communicating with an associated one of the first and second compartments, and an associated one of the first and second support means being formed on at least one of the left, center and right upstanding support walls at a position in alignment with said opening and projecting into said associated compartment for assisting to support whichever of said booklet or writing surface means as may be received in said associated compartment; and (j) the first and second front walls, the formation means, the first support means and the second support means being configured and oriented with respect to the common plane of the first and second front walls such that their frontward-facing surface portions may be formed in toto by one of a pair of mold halves which are arranged to move relative to each other during opening and closing along a path of travel which extends perpendicular to the common plane of the first and second front walls, and such that their rearward-facing surface portions may be formed in toto by the other of said pair of mold halves.

8. The rack of claim 7 wherein each of the first and second support means includes a pair of projections which extend into the associated compartment from locations along such support walls as define opposite sides of the associated compartment.

9. The rack of claim 7 wherein the formation means include a pair of curved, hook-shaped projections which cooperate with the associated support wall to define a forwardly-facing holder for receiving and supporting an elongate writing instrument.

10. The rack of claim 7 wherein the formation means include a pair of structures extending forwardly with respect to the center upstanding support wall to define a forwardly-facing holder for receiving and supporting an elongate writing instrument at a location between the first and second compartments.

11. The rack of claim 7 additionally including upstanding projection means carried on the base wall and extending into said other of the first and second compartments for overlying a front edge portion of a writing surface means positioned therein to assist in retaining the writing surface in said other compartment.

12. The rack of claim 7 additionally including upstanding projection means carried on the base wall and extending into said one compartment for underlying a rear edge portion of a booklet positioned therein.

* * * * *